US007948345B2

(12) United States Patent
Kurokawa

(10) Patent No.: US 7,948,345 B2
(45) Date of Patent: May 24, 2011

(54) TRANSFORMER AND TRANSFORMER DEVICE

(75) Inventor: Takashi Kurokawa, Chaingmai (TH)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/849,974

(22) Filed: Aug. 4, 2010

(65) Prior Publication Data

US 2010/0315189 A1 Dec. 16, 2010

Related U.S. Application Data

(63) Continuation of application No. PCT/JP2008/072915, filed on Dec. 17, 2008.

(30) Foreign Application Priority Data

Feb. 6, 2008 (JP) ..... 2008-025839

(51) Int. Cl.
*H01F 27/30* (2006.01)

(52) U.S. Cl. ..... 336/198

(58) Field of Classification Search ..... 336/173, 336/180–184, 198, 200, 220–223, 232
See application file for complete search history.

(56) References Cited

U.S. PATENT DOCUMENTS

| | | | | |
|---|---|---|---|---|
| 6,064,291 | A * | 5/2000 | Urabe et al. | 336/222 |
| 6,075,431 | A * | 6/2000 | Honma | 336/180 |
| 7,116,205 | B2 * | 10/2006 | Hsueh et al. | 336/212 |

FOREIGN PATENT DOCUMENTS

| | | | | |
|---|---|---|---|---|
| EP | 0 803 883 | A1 | | 10/1997 |
| EP | 1 632 964 | A1 | | 3/2006 |
| JP | 59-137640 | U | | 9/1984 |
| JP | 60-78112 | U | | 5/1985 |
| JP | 64-24811 | U | | 2/1989 |
| JP | 01248508 | A | * | 10/1989 |
| JP | 04-133411 | U | | 12/1992 |
| JP | 6-9463 | Y2 | | 3/1994 |
| JP | 6-314626 | A | | 11/1994 |
| JP | 9-35885 | A | | 2/1997 |
| JP | 2658482 | B2 | | 9/1997 |
| JP | 9-293613 | A | | 11/1997 |
| JP | 10-243656 | A | | 9/1998 |
| JP | 3130200 | B2 | | 1/2001 |
| JP | 2005-327977 | A | | 11/2005 |
| WO | 2004/109723 | A1 | | 12/2004 |

OTHER PUBLICATIONS

Official Communication issued in International Patent Application No. PCT/JP2008/072915, mailed on Apr. 7, 2009.

* cited by examiner

*Primary Examiner* — Tuyen Nguyen
(74) *Attorney, Agent, or Firm* — Keating & Bennett, LLP

(57) ABSTRACT

A transformer that is capable of setting any characteristics of a detection voltage of a detection winding and accurately detecting an output voltage includes a bobbin, a magnetic core, a first input winding, an output winding, a second input winding, and a detection winding. The bobbin is tubular and includes a plurality of winding regions located at its outer portion. The magnetic core is inserted in the bobbin. The first input winding is wound in a first winding region. The output winding is wound in a second winding region adjacent to the first winding region. The second input winding is wound in a third winding region adjacent to the second winding region. The detection winding is wound in the vicinity of the first input winding. The first input winding and the second input winding have different numbers of turns and are connected in series in the same winding direction.

8 Claims, 12 Drawing Sheets

TRANSFORMER AND TRANSFORMER DEVICE

BACKGROUND OF THE INVENTION

1. Field of the Invention

The present invention relates to a transformer including a detection winding arranged to detect an output voltage and to a transformer device including a transformer and a load circuit connected thereto.

2. Description of the Related Art

To apply a specific voltage to a load circuit connected downstream of a transformer, an output voltage of the transformer may be monitored to control the output voltage. One example of a monitoring method involves monitoring a detection voltage of a detection winding provided in the transformer in addition to input and output windings (see, for example, Japanese Examined Utility Model Registration Application Publication No. 6-9463).

FIGS. 1A and 1B are an illustration for describing a first configuration example of a traditional transformer; wherein FIG. 1A illustrates a partial cross-sectional view, and FIG. 1B illustrates a circuit diagram.

The transformer is made up of a roll 200 and a not-illustrated magnetic core. The roll 200 is made up of a tubular bobbin 204 and windings 201 to 203. The magnetic core is inserted in the tube of the bobbin 204. The bobbin 204 has a plurality of collars formed on its outer surface. The windings 201 to 203 are wound in winding regions between the collars (hereinafter referred to as sections). Specifically, the input winding 201 and the detection winding 203 are wound in a section adjacent to a first end, and the output winding 202 is wound in the other sections. The detection winding 203 is wound in a section different from the sections for the output winding 202 in order to isolate itself from the output winding 202.

In this transformer circuit configuration, the input winding 201 is connected between an input terminal 214 and a ground terminal 216. The input terminal 214 is connected to an AC voltage source. The detection winding 203 is connected to a voltage detector through a detection terminal 217. The output winding 202 is connected to a load circuit through an output terminal 215. For this transformer, a detection voltage proportional to an output voltage is detected by the voltage detector.

For the transformer having the above configuration, an input winding may be disposed at each of two sides of an output winding and the input windings may be connected in parallel in order to acquire strong connection between the output and input windings.

FIGS. 2A and 2B are illustrations for describing a second configuration example of a traditional transformer, wherein FIG. 2A illustrates a partial cross-sectional view, and FIG. 2B illustrates a circuit diagram.

The transformer is made up of a roll 300 and a not-illustrated magnetic core. The roll 300 is made up of a tubular bobbin 310 and windings 311 to 314. The magnetic core is inserted in the tube of the bobbin 310. The bobbin 310 has a plurality of collars formed on its outer surface. The windings 311 to 314 are wound in sections between the collars. The output winding 313 is wound in central sections, the first input winding 311 and the second input winding 312 are wound in sections adjacent to opposite ends, and the detection winding 314 is wound in the same section as that for the first input winding 311.

In this transformer circuit configuration, the first input winding 311 and the second input winding 312 are connected in parallel between an input terminal 321 and a ground terminal 322. The detection winding 314 is connected to a voltage detector through a detection terminal 323. The output winding 313 is connected to a load circuit through an output terminal 324. Also with this transformer, a voltage proportional to an output voltage according to the turns ratio between the output winding and the detection winding is detected by the voltage detector.

With the above transformer, for example, when the number of turns of the output winding is 1000, the number of turns of the detection winding is 10, and the output voltage is 1000 Vp-p, a detection voltage of 10 Vp-p is output to the detection winding.

For the above-described transformers, to acquire isolation, the output and input windings are spaced away from each other with the collar disposed between. Therefore, a leakage inductance between the both windings is large. Accordingly, if a capacitive load circuit that mainly has a capacitive component, such as a lamp or a photosensitive drum, is connected as the load circuit, the leakage inductance and the capacitive load circuit may be series resonant, depending on a condition, for example, such as a condition in which the frequency of an AC input voltage is close to a resonant frequency between the leakage inductance and the load capacity. If series resonance occurs, a leakage flux resulting from the leakage inductance increases.

A leakage flux is proportional to a series resonance current, and the series resonance current is proportional to a series resonance voltage occurring in a leakage inductance. The output voltage of the transformer increases by the amount corresponding to the series resonance voltage. Therefore, due to the series resonance, a resonance voltage proportional to the increase in the leakage flux occurs in the leakage inductance, and the output voltage of the transformer increases.

Due to series resonance, a detection voltage corresponding to a combined magnetic flux of a main magnetic flux and a leakage flux is output from a detection winding. FIGS. 3A and 3B are illustrations for describing a leakage flux occurring in a traditional transformer. FIG. 3A illustrates a transformer according to a first configuration example, and FIG. 3B illustrates a transformer according to a second configuration example.

For the transformer according to the first configuration example, a main magnetic flux 221 and a leakage flux 222 occur inside a magnetic core 220. The leakage flux 222 links the main magnetic flux 221 in the opposite direction at a linkage surface 223 of the detection winding. Accordingly, the main magnetic flux 221 and the leakage flux 222 cancel each other. During series resonance, the leakage flux 222 increases largely, so the main magnetic flux 221 is largely cancelled by the amount corresponding to the increase in the leakage flux 222, and the detection voltage reduces. Similarly, for the transformer according to the second configuration example, during series resonance, a main magnetic flux 321 is cancelled by the amount corresponding to an increase in a leakage flux 323 at a linkage surface 323, and the detection voltage reduces.

As described above, when an output voltage and a detection voltage are changed by the effects of series resonance, the accuracy of detecting an output voltage using a detection winding deteriorates.

FIGS. 4A and 4B are illustrations for describing changes in an output voltage and a detection voltage.

Here, results of experiments of applying an AC input voltage that has a constant magnitude with varying frequencies to a traditional transformer with an input winding-output winding-detection winding ratio of 1:180:1 and driving the transformer when a capacitive load circuit switches to 100 pF, 200 pF, or 300 pF are illustrated.

FIG. 4A illustrates the transformer according to the first configuration example. The output voltage of this transformer tended to increase with an increase in frequency. In contrast, the detection voltage of this transformer tended to reduce or remain virtually unchanged with an increase in frequency. Therefore, a calculated ratio between the detection voltage and the output voltage changed with respect to a change in frequency in a non-linear fashion.

FIG. 4B illustrates the transformer according to the second configuration example. In comparison with the transformer according to the first configuration example, the degree of each of the change in the output voltage and that in the detection voltage is smaller. However, similar to the transformer according to the first configuration example, the ratio between the detection voltage and the output voltage changed with respect to a change in frequency in a non-linear fashion.

As described above, for the traditional transformer, if the frequency varied, the accuracy of detecting the output voltage using the detection winding significantly deteriorated. This was more noticeable at larger capacitive values of the capacitive load circuit connected to the output winding.

SUMMARY OF THE INVENTION

Accordingly, preferred embodiments of the present invention provide a transformer and a transformer device that are capable of accurately detecting an output voltage.

A transformer according to a preferred embodiment tof the present invention includes a bobbin, a magnetic core, a first input winding, an output winding, a second input winding, and a detection winding. The bobbin is tubular and includes a plurality of winding regions located at its outer portion. The magnetic core is inserted in the bobbin. The first input winding is wound in a first winding region. The output winding is wound in a second winding region adjacent to the first winding region. The second input winding is wound in a third winding region adjacent to the second winding region. The detection winding is wound in the vicinity of the first input winding. The first input winding and the second input winding are connected in series in the same winding direction, and the number of turns of the first input winding is smaller than that of the second input winding.

With this configuration, a main magnetic flux, a first leakage flux resulting from a leakage inductance between the first input winding and the output winding, and a second leakage flux resulting from a leakage inductance between the second input winding and the output winding occur.

Because the first input winding and the second input winding are connected in series, substantially the same amount of current passes through both of the windings. However, the first input winding has a number of turns that is smaller than that of the second input winding, the AT (ampere-turn: the number of turns×current) of the first input winding is smaller than the AT of the second input winding, and the first leakage flux is smaller than the second leakage flux.

Magnetic lines of force of the first leakage flux that link the detection winding extend in the opposite direction to the main magnetic flux, whereas magnetic lines of force of the second leakage flux that link the detection winding extend in the same direction as the main magnetic flux. Thus, of a magnetic flux that links the detection winding, a component resulting from the first leakage flux is cancelled by that resulting from the second leakage flux, and the direction of the magnetic flux linking the detection winding is the same as the main magnetic flux. Accordingly, in accordance with the magnitude of the leakage flux, the detection voltage increases. Thus, even when the frequency varies and the output voltage changes, the detection voltage follows the leakage flux varying in proportion to the frequency and changes correspondingly, so the ratio between the output voltage and the detection voltage can be stabilized.

A transformer according to another preferred embodiment of the present invention includes a bobbin, a magnetic core, a first detection winding, an output winding, a second detection winding, and an input winding. The bobbin is tubular and includes a plurality of winding regions located at its outer portion. The magnetic core is inserted in a tube of the bobbin. The first detection winding is wound in a first winding region. The output winding is wound in a second winding region adjacent to the first winding region. The second detection winding is wound in a third winding region adjacent to the second winding region. The input winding is wound in the vicinity of the first detection winding. The first detection winding and the second detection winding are connected in series in the same winding direction, and the number of turns of the first detection winding is smaller than that of the second detection winding.

With this configuration, a leakage flux occurs resulting from a leakage inductance between the input winding and the output winding. Of this leakage flux, magnetic lines of force that link the first detection winding extend in the opposite direction to the magnetic flux, whereas magnetic lines of force that link the second detection winding extend in the same direction as the main magnetic flux. Thus, in accordance with the magnitude of the leakage flux, the magnetic flux linking the first detection winding reduces, and the magnetic flux linking the second detection winding increases.

Because the number of turns of the first detection winding is smaller than that of the second detection winding, the winding voltage occurring in the second detection winding is larger than that in the first detection winding. Therefore, the detection voltage, which is a combined voltage of respective winding voltages of the first and second detection windings connected in series, is largely affected by a winding voltage occurring in the second detection winding and easily increases in accordance with the magnitude of the leakage flux. Accordingly, even if the frequency varies and the output voltage changes, the detection voltage follows the leakage flux varying in proportion to the frequency and changes correspondingly, so the ratio between the output voltage and the detection voltage can be stabilized.

A transformer according to another preferred embodiment of the present invention has its input and output windings interchanged compared to the circuit configurations of the transformers according to the preferred embodiments described above. Because circuit configurations according to various preferred embodiments of the present invention have reversibility, even if the windings are interchanged in this way, similar advantages are obtainable.

A transformer device according to a preferred embodiment of the present invention may include any one of the above-described transformers, a capacitive load circuit connected to the output winding, an AC voltage source connected to the input winding, and a detector connected to the detection winding.

With a transformer and a transformer device according to any of the various preferred embodiments of the present invention, a detection voltage following a change in leakage flux is obtainable. Thus, the ratio between the output voltage and the detection voltage can be accurately stabilized and the output voltage can be detected.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
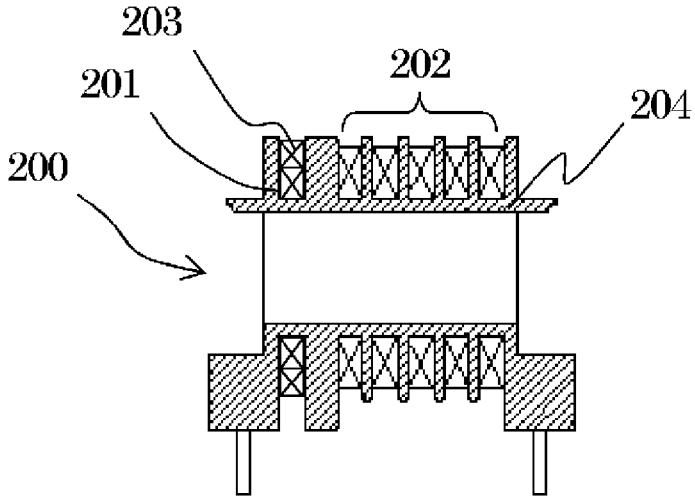
FIG. 1A PRIOR ART
FIGS. 1A and 1B are illustrations for describing a first configuration example of a traditional transformer.
Figure 1B:
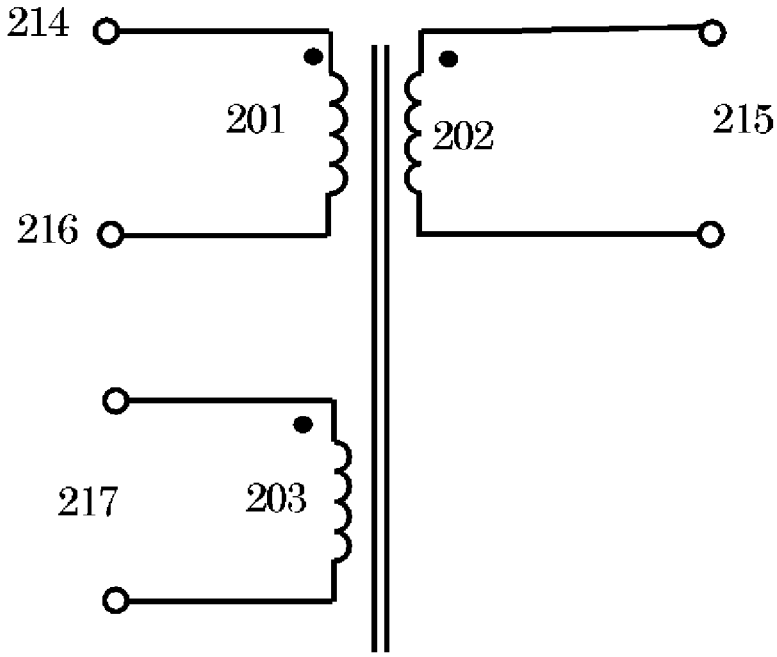
FIG. 1B PRIOR ART
Figure 2A:
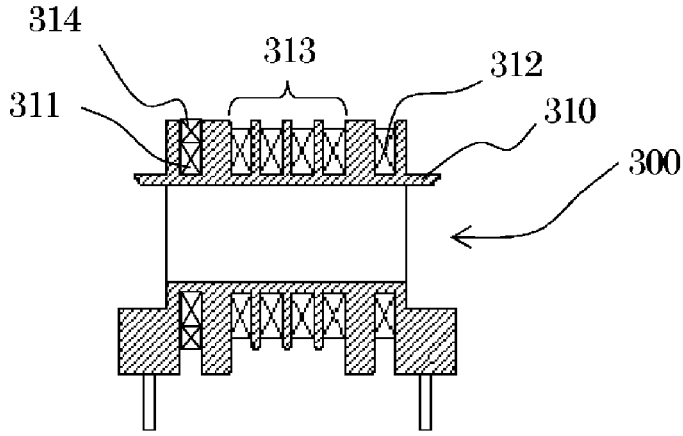
FIG. 2A PRIOR ART
FIGS. 2A and 2B are illustrations for describing a second configuration example of a traditional transformer.
Figure 2B:
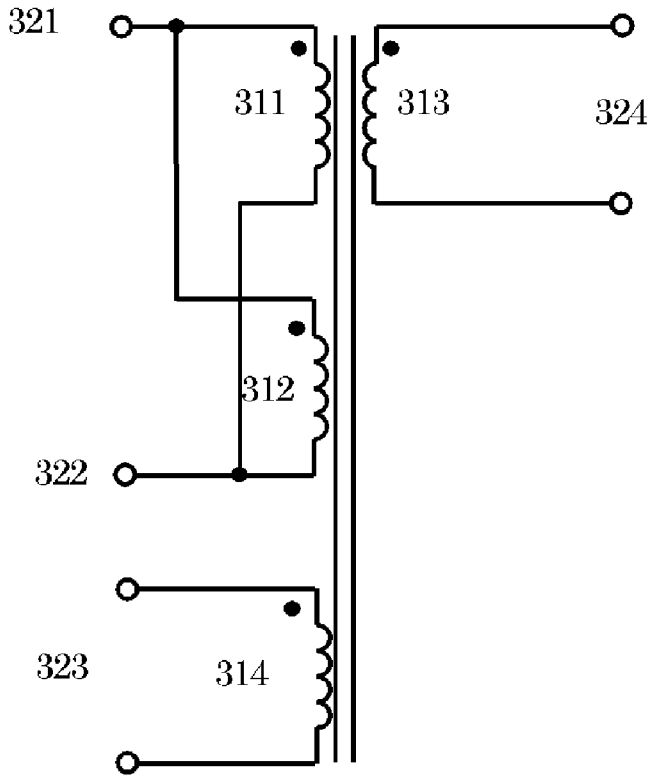
FIG. 2B PRIOR ART
Figure 3A:
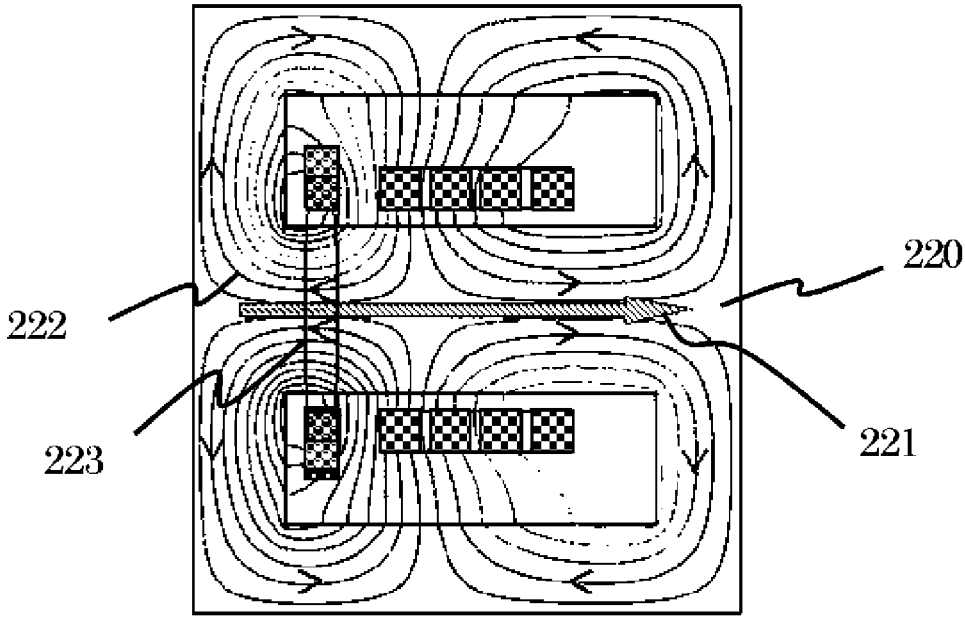
FIG. 3A PRIOR ART
FIGS. 3A and 3B are illustrations for describing a leakage flux of a traditional transformer.
Figure 3B:
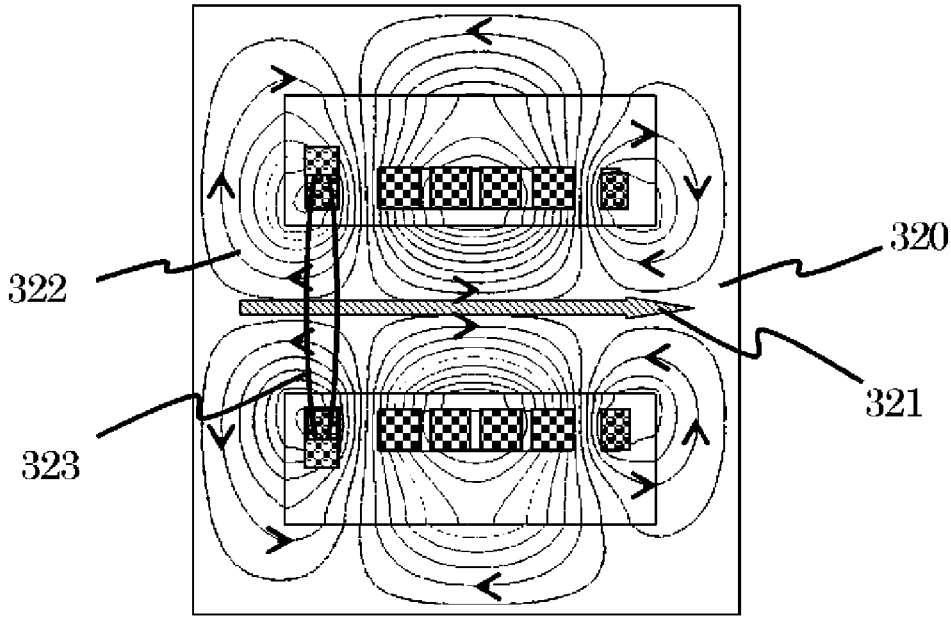
FIG. 3B PRIOR ART
Figure 4A:
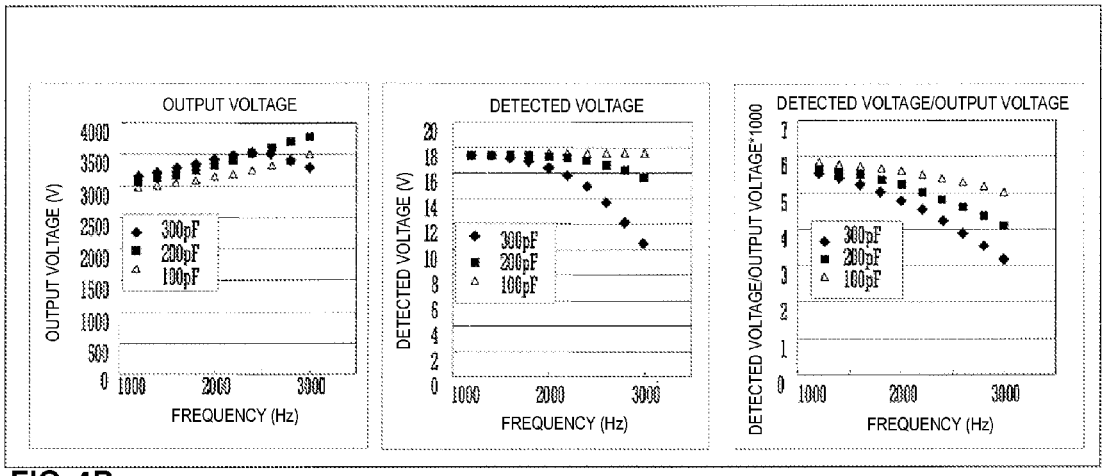
FIG. 4A PRIOR ART
FIGS. 4A and 4B are illustrations for describing a relationship between an output voltage and a detection voltage of a traditional transformer.
Figure 4B:
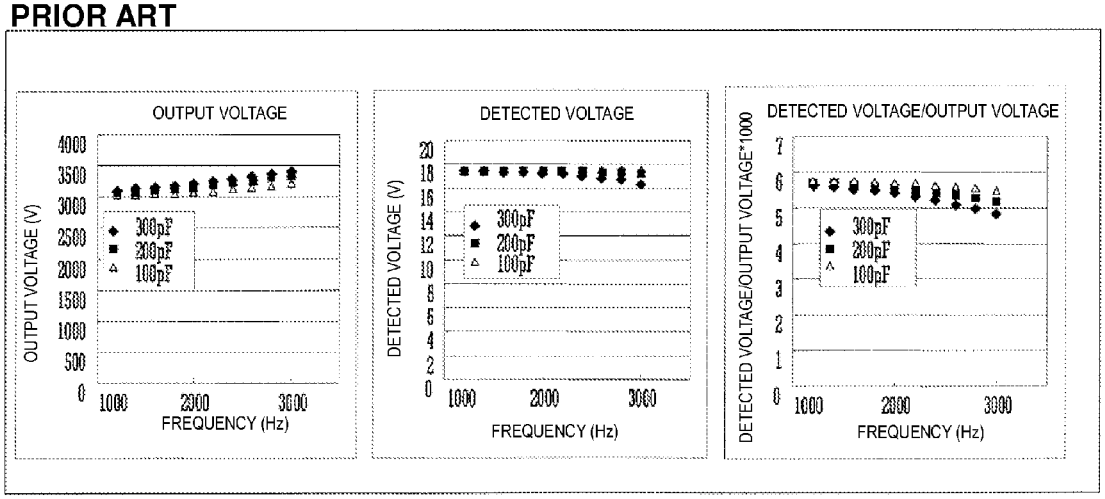
FIG. 4B PRIOR ART
Figure 5A:
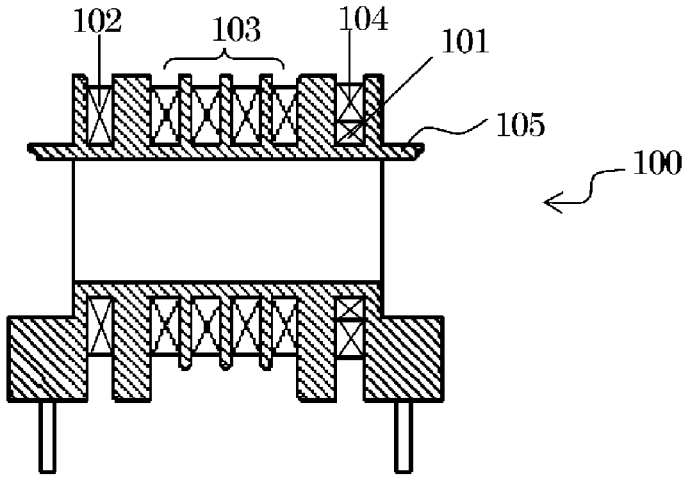
FIGS. 5A and 5B are illustrations for describing a configuration of a transformer according to a first preferred embodiment.
Figure 5B:
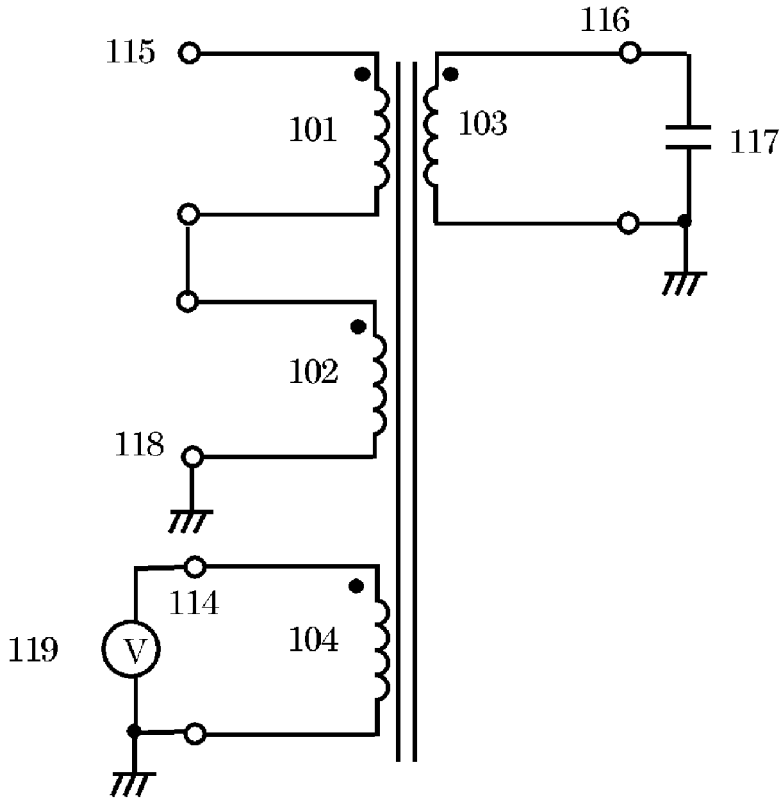

A transformer according to a first preferred embodiment of the present invention is described below. FIGS. 5A and 5B are illustrations for describing the transformer according to this preferred embodiment of the present invention. FIG. 5A illustrates a partial cross-sectional view of the transformer, and FIG. 5B illustrates a circuit diagram of a transformer device that includes the transformer and a load circuit connected thereto.

The transformer preferably includes a roll 100 and a not-illustrated magnetic core. The roll 100 preferably includes a tubular bobbin 105 and windings 101 to 104. The magnetic core is inserted in the tube of the bobbin 105. The bobbin 105 includes a plurality of collars located on its outer surface. The sections between the collars are adjacent with the collars disposed therebetween, and the windings 101 to 104 are wound in the sections. Specifically, the input winding 101 and the detection winding 104 are wound in the section at a first end, the input winding 102 is wound in the section at a second end, and the output winding 103 is wound in the central sections. The detection winding 104 is disposed in the same section as that for the input winding 101 and lies in the vicinity of the input winding 101. The detection winding 104 is wound outside of the input winding 101. A configuration in which the detection winding is wound inside and the input winding is wound outside may be used. The detection winding 104 is wound in a section different from the sections for the output winding 103 in order to isolate itself from the output winding 103.

The turns ratio between the input winding 101 and the input winding 102 can be determined depending on necessary frequency characteristics of the detection winding. Here, the turns ratio of the input winding 101 to the input winding 102 is set at 3 to 7, for example, so that the detection voltage of the detection winding 104 and the output voltage of the output winding 103 are constant independently of the frequency of the AC input voltage.

Next, a circuit configuration of a transformer device including that transformer and a load circuit connected thereto is described. A first end of the input winding 101 is connected to an input terminal 115, and a second end thereof is connected to the input winding 102. An end of the input winding 102 that is opposite to another end connected to the input winding 101 is connected to a ground through a ground terminal 118. The input winding 101 and the output winding 102 are connected to each other such that their winding directions are the same. The input terminal 115 is connected to a not-illustrated AC voltage source. The detection winding 104 is connected to a voltage detector 119 through a detection terminal 114. The output winding 103 is connected to a capacitive load circuit 117 through an output terminal 116.

With that circuit configuration, due to the occurrence of series resonance, a first leakage flux from a first leakage inductance between the input winding 101 and the output winding 103 and a second leakage flux from a second leakage inductance between the input winding 102 and the output winding 103 increase.

Because the input winding 101 and the input winding 102 are connected in series, substantially the same amount of current passes through both of the windings, so the ratio of the AT (ampere-turn: the number of turns×current) of the input winding 101 to the AT of the input winding 102 is 3 to 7, which is the same as the turns ratio. Therefore, the leakage flux is separated such that the ratio between the first leakage flux occurring between the input winding 101 and the output winding 103 and the second leakage flux occurring between the input winding 102 and the output winding 103 is also approximately 3:7.

Figure 6A:
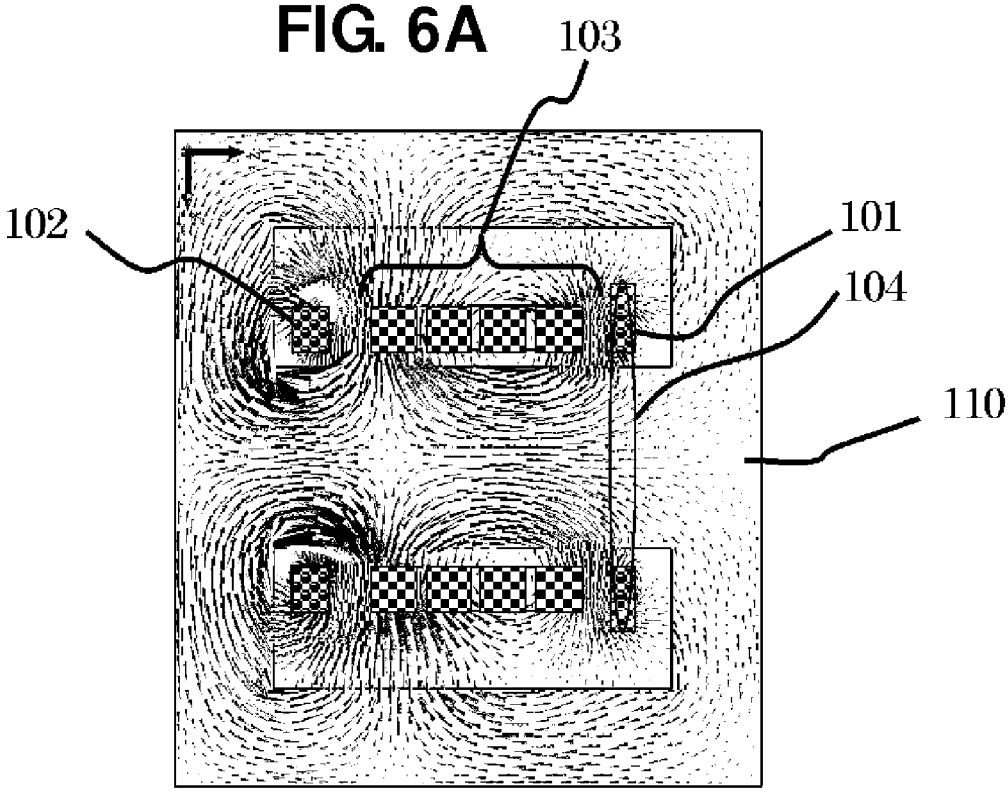
FIGS. 6A and 6B are illustrations for describing a leakage flux of the transformer illustrated in FIGS. 5A and 5B.
Figure 6B:
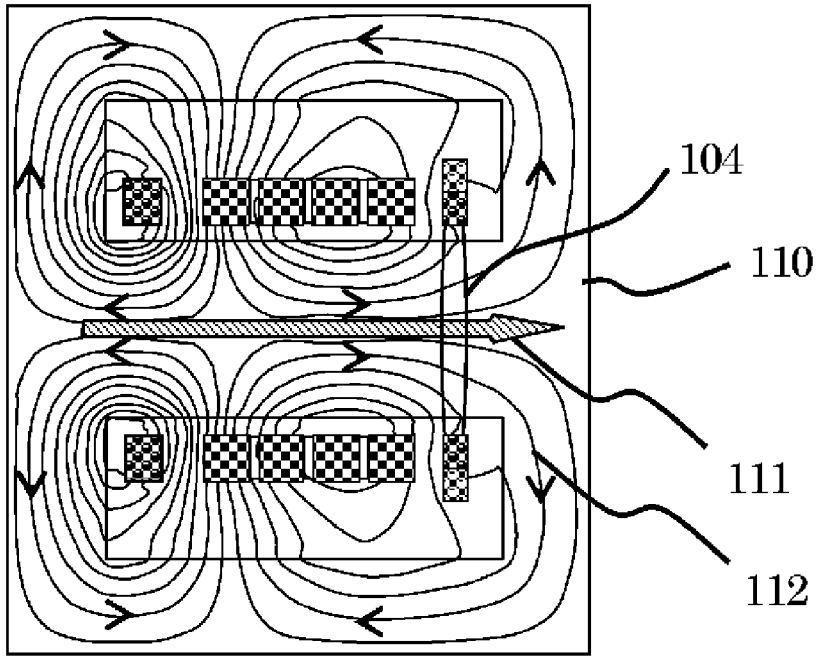

FIGS. 6A and 6B are illustrations for describing a leakage flux of that transformer. FIG. 6A illustrates a simulation image of this transformer, and FIG. 6B illustrates directions of a magnetic flux in this simulation image. With this transformer, a main magnetic flux 111 and a leakage flux 112 occur inside a magnetic core 110. The leakage flux 112 illustrated here is a combined magnetic flux of a first leakage flux and a second leakage flux. The direction of the combined magnetic flux that links the detection winding 104 is the same as that of the main magnetic flux.

Figure 7:
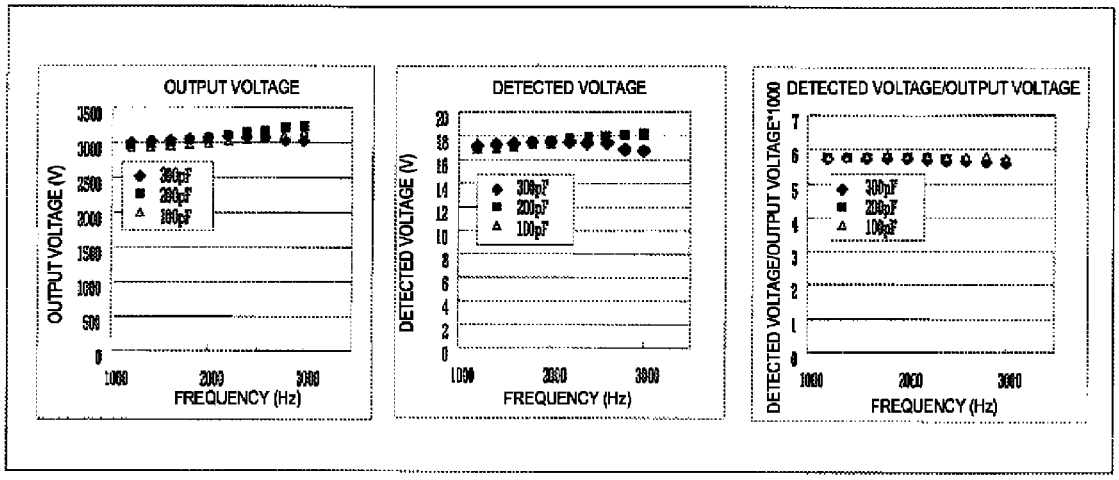
FIG. 7 is illustrations for describing a relationship between an output voltage and a detection voltage of the transformer illustrated in FIGS. 5A and 5B.

FIG. 7 is illustrations for describing changes in an output voltage and in a detection voltage of the transformer according to the present preferred embodiment.

Here, results of experiments of applying an AC input voltage that has a constant magnitude with varying frequencies to a transformer with an input winding-output winding-detection winding ratio of 1:180:1 and driving the transformer when the capacitive load circuit switches to 100 pF, 200 pF, or 300 pF are illustrated.

The output voltage of that transformer tended to increase with an increase in frequency. The detection voltage also tended to increase with an increase in frequency. Therefore, it is revealed that, irrespective of differences in frequency or a capacitive load circuit, the ratio between the detection voltage and the output voltage is stable, and high detection accuracy can be maintained.

Here, an example in which the turns ratio between the first and second input windings is set such that the amount of change in the detection voltage is approximately equivalent to the amount of change in the output voltage has been illustrated. However, any amount of change in the detection voltage with respect to frequency change can be set in accordance with the turns ratio between the input windings, so the amount of change in the detection voltage can also be set larger or smaller than the amount of change in the output voltage.

Figure 8A:
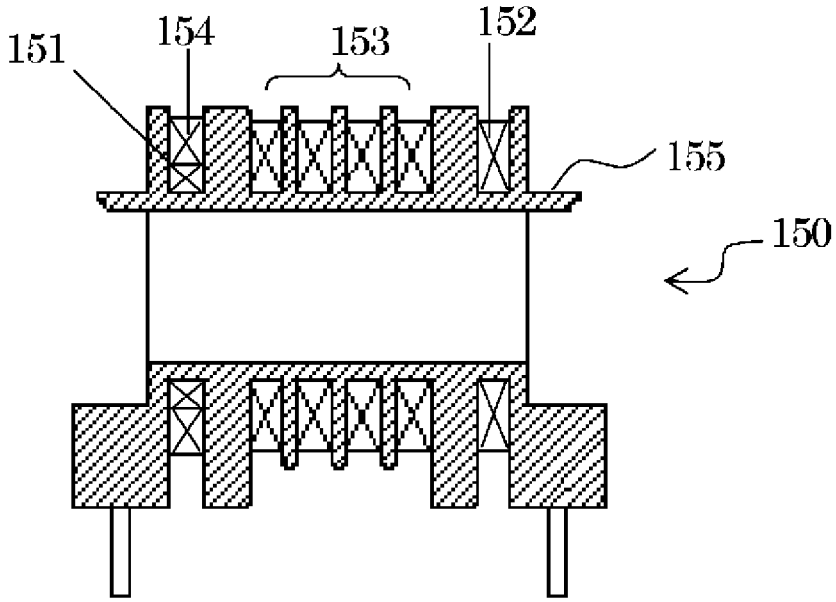
FIGS. 8A and 8B are illustrations for describing a configuration of a transformer according to a second preferred embodiment.
Figure 8B:
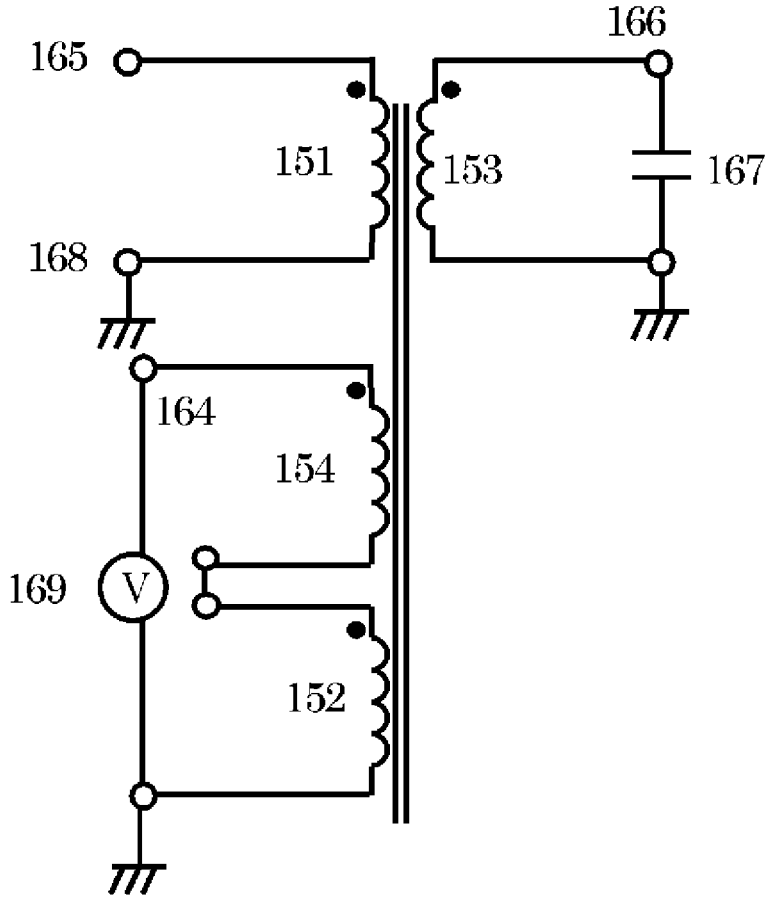

Next, a transformer according to the second preferred embodiment is described. FIGS. 8A and 8B are illustrations for describing the transformer. FIG. 8A illustrates a partial cross-sectional view of the transformer, and FIG. 8B illustrates a circuit diagram of a transformer device that includes the transformer and a load circuit connected thereto.

The transformer is made up of a roll 150 and a not-illustrated magnetic core. The roll 150 preferably includes a tubular bobbin 155 and windings 151 to 154. The magnetic core is inserted in the tube of the bobbin 155. The bobbin 155 includes a plurality of collars located on its outer surface. The sections between the collars are adjacent with the collars disposed therebetween, and the windings 151 to 154 are wound in the sections. Specifically, the detection winding 152 is wound in the section at a first end, the input winding 151 and the detection winding 154 are wound in the section at a second end, and the output winding 153 is wound in the sections at the central sections. The input winding 151 is disposed in the same section as that for the detection winding 154 and lies in the vicinity of the detection winding 154. The detection winding 154 is wound outside the input winding 151. A configuration in which the detection winding is wound inside and the input winding is wound outside may be used. Each of the detection windings 154 and 152 is wound in a section different from the sections for the output winding 153 in order to isolate itself from the output winding 153.

The turns ratio between the detection winding 154 and the detection winding 152 can be determined depending on necessary frequency characteristics of the detection windings. Here, the turns ratio of the detection winding 154 to the detection winding 152 is set at 3 to 7, for example, so that the detection voltage of the series circuit of the detection windings 152 and 154 and the output voltage of the output winding 153 are constant independent of the frequency of the AC input voltage.

The transformer according to the second preferred embodiment preferably has a configuration in which a leakage inductance between the input winding and the output winding is larger than that of the first preferred embodiment and series resonance with the capacitive load circuit can be used more easily. Therefore, this transformer may be preferably used in a load circuit that uses high voltage, such as an inverter for use in a liquid crystal display device.

Next, a circuit configuration of a transformer device including that transformer and a load circuit connected thereto is described. A first end of the input winding 151 is connected to an input terminal 165, and a second thereof is connected to a ground through a ground terminal 168. The input terminal 165 is connected to a not-illustrated AC voltage source. The detection windings 152 and 154 are connected in series, and their opposite ends are connected to a voltage detector 169 through a detection terminal 164. The detection windings 152 and 154 are connected such that their winding directions are the same. The output winding 153 is connected to a capacitive load circuit 167 through an output terminal 166.

With that circuit configuration, due to the occurrence of series resonance, a leakage flux from a leakage inductance between the input winding 151 and the output winding 153 increases.

Figure 9A:
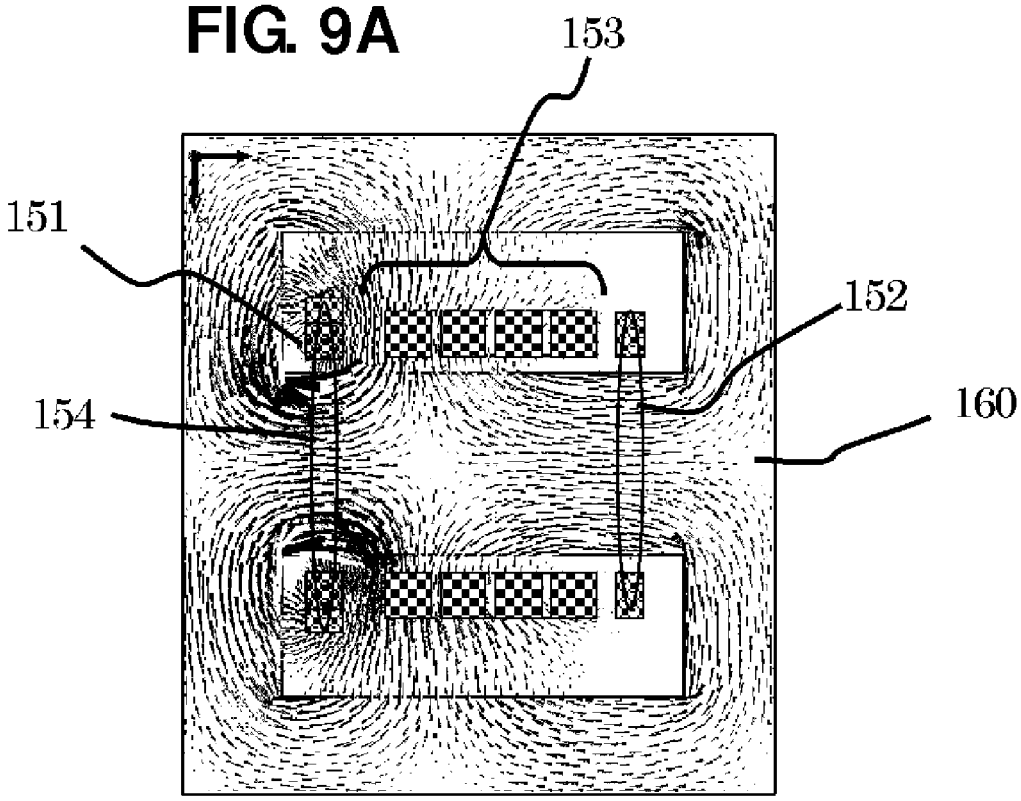
FIGS. 9A and 9B are illustrations for describing a leakage flux of the transformer illustrated in FIGS. 8A and 8B.
Figure 9B:
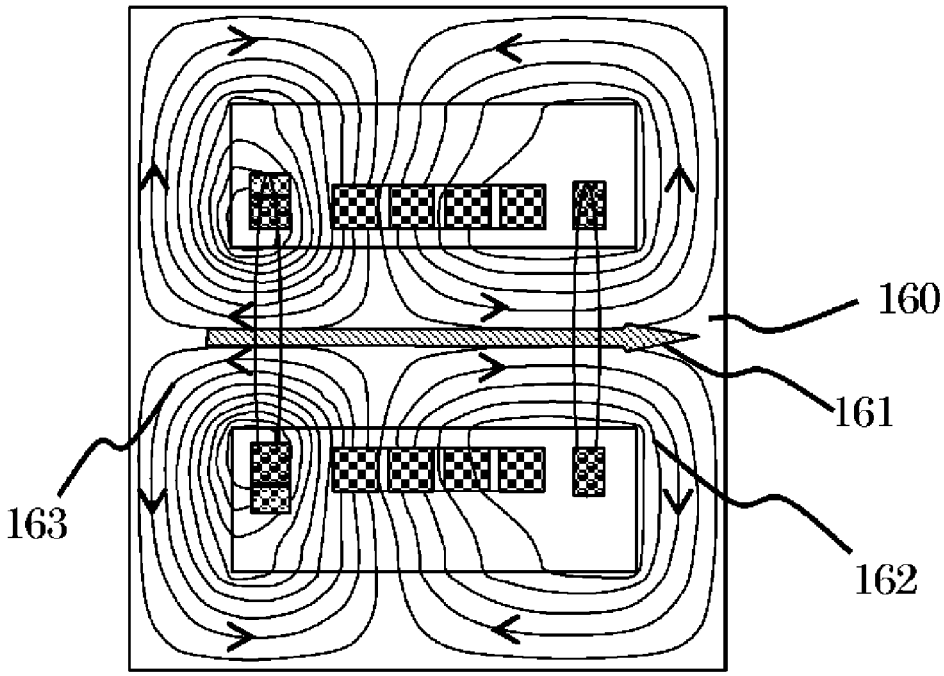

FIGS. 9A and 9B are illustrations for describing a leakage flux of that transformer. FIG. 9A illustrates a simulation image of the transformer, and FIG. 9B illustrates directions of a magnetic flux in this simulation image. With this transformer, a main magnetic flux 161 and leakage fluxes 162 and 163 occur inside a magnetic core 160.

Of the leakage fluxes 162 and 163, a component that links the detection winding 154 flows in the opposite direction to the main magnetic flux, whereas a component that links the detection winding 152 flows in the same direction as the main magnetic flux. Hence, due to the leakage fluxes, the detection voltage of the detection winding 152 is large, whereas in contrast the detection voltage of the detection winding 154 is small. If the turns ratio of the detection winding 152 to the detection winding 154 is increased, the detection voltage of the series circuit of the detection winding 154 and the detection winding 152 is increased. In contrast, if the turns ratio of the detection winding 152 is reduced, the detection voltage is reduced. Accordingly, due to the effects of the series resonance, with an increase in leakage flux, the detection voltage can be increased or reduced.

Figure 10:
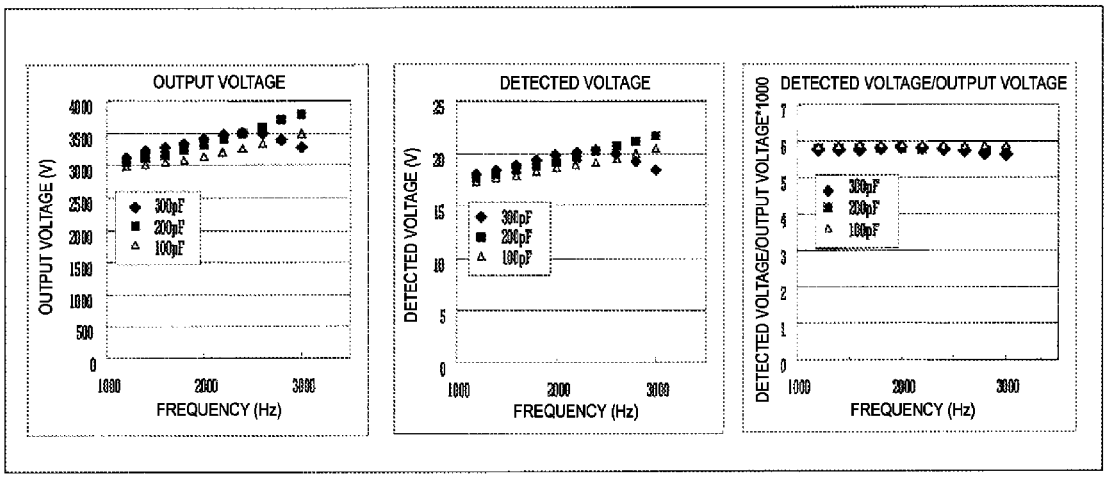
FIG. 10 is illustrations for describing a relationship between an output voltage and a detection voltage of the transformer illustrated in FIGS. 8A and 8B.

FIGS. 10A and 10B are illustrations for describing changes in an output voltage and in a detection voltage of the transformer according to the present preferred embodiment.

Here, results of experiments of applying an AC input voltage that has a constant magnitude with varying frequencies to a transformer with an input winding-output winding-detection winding ratio of 1:180:1 and driving the transformer when the capacitive load circuit switches to 100 pF, 200 pF, or 300 pF are illustrated.

The output voltage of that transformer tended to increase with an increase in frequency. The detection voltage also tended to increase with an increase in frequency. Therefore, it is revealed that, irrespective of differences in frequency or a capacitive load circuit, the ratio between the detection voltage and the output voltage is stable, and high detection accuracy can be maintained.

Here, an example in which the turns ratio between the first and second detection windings is set such that the amount of change in the detection voltage is approximately equivalent to the amount of change in the output voltage has been illustrated. However, any amount of change in the detection voltage with respect to frequency change can be set in accordance with the turns ratio between the input windings, so the amount of change in the detection voltage can also be set larger or smaller than the amount of change in the output voltage.

As described above, with various preferred embodiments of the present invention, even if the input AC voltage varies and the output voltage changes, that output voltage can be accurately detected.

Even with a circuit configuration that uses an input winding as an output winding or uses an output winding as an input winding, both of the windings being illustrated above, preferred embodiments of the present invention can be suitably carried out.

Next, a circuit configuration example in which the input and output connections in the transformer according to each of the above-described preferred embodiments are interchanged such that the input winding is used as the output winding and the output winding is used as the input winding are described.

Figure 11A:
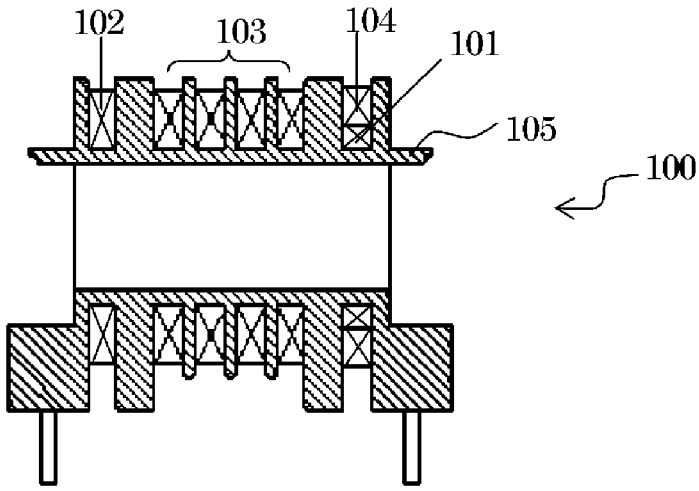
FIGS. 11A and 11B are illustrations for describing a circuit configuration in which the input and output windings of the transformer according to the first preferred embodiment are interchanged.
Figure 11B:
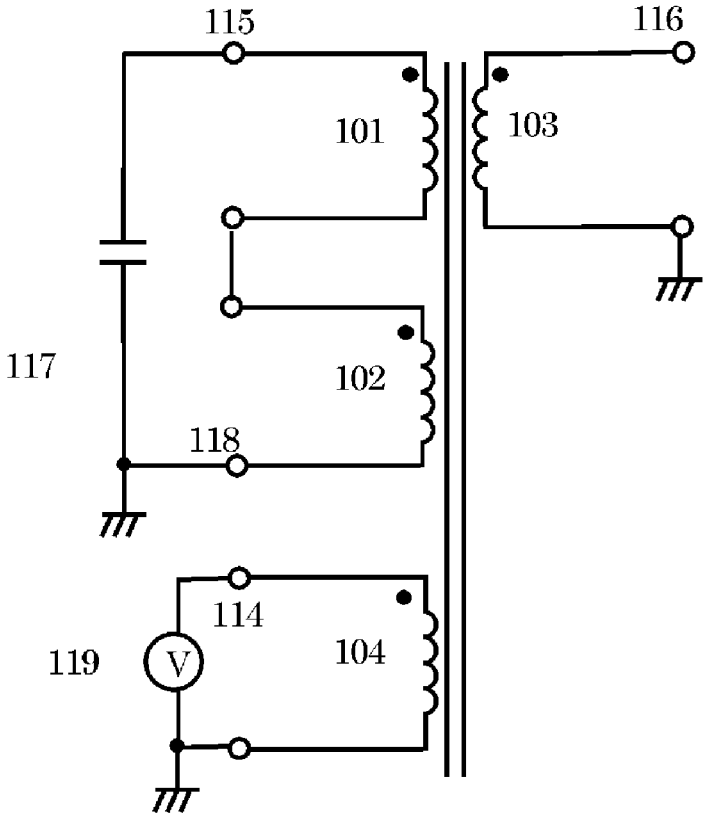

FIGS. 11A and 11B are illustrates for describing a configuration example in which the input winding and the output winding in the transformer according to the first preferred embodiment are interchanged. FIG. 11A illustrates a partial cross-sectional view of the transformer, and FIG. 11B illustrates a circuit diagram of a transformer device that includes the transformer and a load circuit connected thereto.

The roll 100 of that transformer is preferably the same as the roll of the first preferred embodiment. The winding 101 wound together with the detection winding 104 in the section at the first end is used as not an input winding but an output winding. The winding 102 wound in the section at the second end is also used as not an input winding but an output winding. The winding 103 wound in the central sections is used as an output winding. A configuration in which the detection winding 104 is wound inside the winding 101 may be used.

The turns ratio between the winding 101 and the winding 102, each of which is the output winding, can be set in accordance with necessary frequency characteristics of the detection winding. Here, the turns ratio of the winding 101 to the winding 102 is set at 3 to 7, for example, so that the detection voltage from the detection winding 104 and the output voltage from the windings 101 and 102 are constant independent of the frequency of the AC input voltage.

Next, a circuit configuration of a transformer device including that transformer and a load circuit connected thereto is described. A first end of the winding 103 is connected to a not-illustrated AC voltage source through the terminal 116, and a second end thereof is connected to a ground. The winding 101 and the winding 102 are connected in series and connected to the capacitive load circuit 117 through the terminals 115 and 118. The winding 101 and the winding 102 are connected such that their winding directions are the same. The detection winding 104 is connected to the voltage detector 119 through the detection terminal 114.

With that circuit configuration, due to the occurrence of series resonance, a first leakage flux from a first leakage inductance between the winding 101 and the winding 103 and a second leakage flux from a second leakage inductance between the winding 102 and the winding 103 increase.

Because the winding 101 and the winding 102 are connected in series, substantially the same amount of current passes through both windings, so the ratio between the AT (ampere-turn: the number of turns×current) of the winding 101 and the AT of the winding 102 is 3:7, which is the same as the turns ratio. Therefore, the leakage flux is separated such that the ratio of the first leakage flux occurring between the winding 101 and the winding 103 to the second leakage flux occurring between the winding 102 and the winding 103 is also approximately 3 to 7.

Also with this transformer, irrespective of differences in frequency or a capacitive load circuit, the ratio between the detection voltage and the output voltage is stable, and high detection accuracy can be maintained.

Figure 12A:
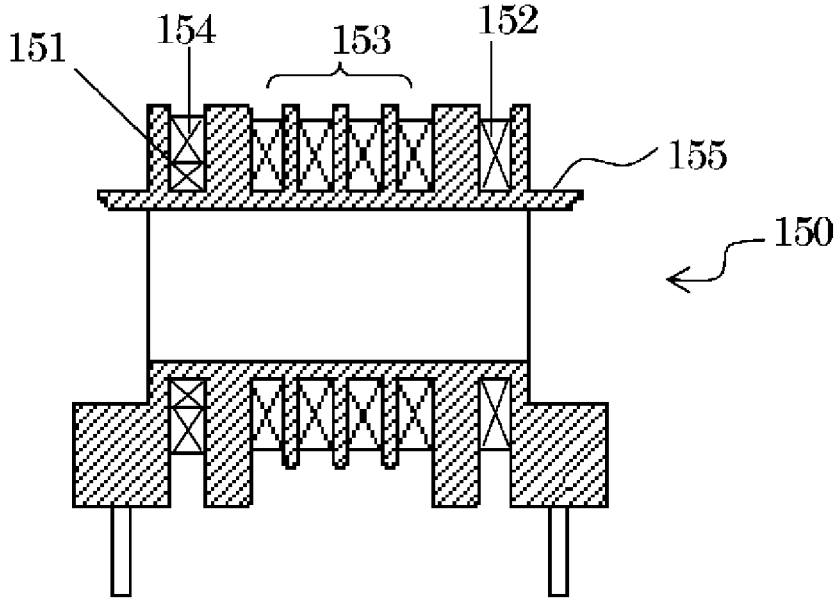
FIGS. 12A and 12B are illustrations for describing a circuit configuration in which the input and output windings of the transformer according to the second preferred embodiment are interchanged.
Figure 12B:
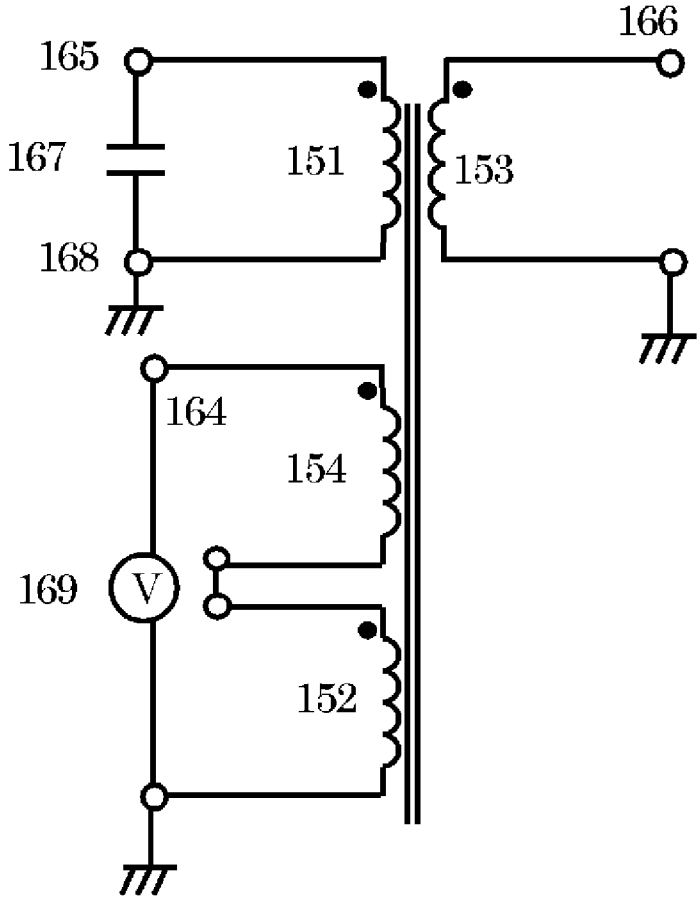

FIGS. 12A and 12B are illustrations for describing a configuration example in which the input winding and the output winding in the transformer according to the second preferred embodiment are interchanged. FIG. 12A illustrates a partial cross-sectional view of the transformer, and FIG. 12B illustrates a circuit diagram of a transformer device that includes the transformer and a load circuit connected thereto.

The roll 150 of that transformer is preferably the same as the roll of the second preferred embodiment. The winding 151 wound together with the detection winding 154 in the section at the first end is used as not an input winding but an output winding. The winding 153 wound in the central sections is used as not an input winding but an output winding. A configuration in which the detection winding 154 is wound inside the winding 151 may be used.

Next, a circuit configuration of a transformer device including that transformer and a load circuit connected thereto is described. A first end of the winding 153 is connected to a not-illustrated AC voltage source through the terminal 166, and a second end thereof is connected to a ground. The winding 151 is connected to the capacitive load circuit 167 through the terminals 165 and 168.

With this circuit configuration, due to the occurrence of series resonance, a leakage flux from a leakage inductance between the winding 151 and the winding 153 increases. Because of this, the detection voltage of the detection winding 152 is large, whereas, in contrast, the detection voltage of the detection winding 154 is small. If the turns ratio of the detection winding 152 to the detection winding 154 is increased, the detection voltage of the series circuit of the detection winding 154 and the detection winding 152 is increased. In contrast, if the turns ratio of the detection winding 152 is reduced, the detection voltage is reduced. Accordingly, with an increase in leakage flux due to the effects of the series resonance, the detection voltage can be increased or reduced. Thus, irrespective of differences in frequency or a capacitive load circuit, the ratio between the detection voltage and the output voltage is stable, and high detection accuracy can be maintained.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A transformer comprising:

a tubular bobbin having a plurality of winding regions formed at its outer portion;

a magnetic core inserted in a tube of the bobbin;

a first input winding wound in a first winding region;

an output winding wound in a second winding region adjacent to the first winding region;

a second input winding wound in a third winding region adjacent to the second winding region; and a detection winding wound in the vicinity of the first input winding, wherein the first input winding and the second input winding are connected in series in the same winding direction, and the number of turns of the first input winding is smaller than that of the second input winding.

2. A transformer comprising:

a tubular bobbin having a plurality of winding regions formed at its outer portion;

a magnetic core inserted in a tube of the bobbin;

a first detection winding wound in a first winding region;

an output winding wound in a second winding region adjacent to the first winding region;

a second detection winding wound in a third winding region adjacent to the second winding region; and an input winding wound in the vicinity of the first detection winding, wherein the first detection winding and the second detection winding are connected in series in the same winding direction, and the number of turns of the first detection winding is smaller than that of the second detection winding.

3. A transformer comprising:

a tubular bobbin having a plurality of winding regions formed at its outer portion;

a magnetic core inserted in a tube of the bobbin;

a first output winding wound in a first winding region;

an input winding wound in a second winding region adjacent to the first winding region;

a second output winding wound in a third winding region adjacent to the second winding region; and a detection winding wound in the vicinity of the first output winding, wherein the first output winding and the second output winding are connected in series in the same winding direction, and the number of turns of the first output winding is smaller than that of the second output winding.

4. A transformer comprising:

a tubular bobbin having a plurality of winding regions formed at its outer portion;

a magnetic core inserted in a tube of the bobbin;

a first detection winding wound in a first winding region;

an input winding wound in a second winding region adjacent to the first winding region;

a second detection winding wound in a third winding region adjacent to the second winding region; and an output winding wound in the vicinity of the first detection winding, wherein the first detection winding and the second detection winding are connected in series in the same winding direction, and the number of turns of the first detection winding is smaller than that of the second detection winding.

5. A transformer device comprising a transformer according to claim 1, further comprising a capacitive load circuit connected to the output winding, an AC voltage source connected to the input winding, and a detector connected to the detection winding.

6. A transformer device comprising a transformer according to claim 2, further comprising a capacitive load circuit connected to the output winding, an AC voltage source connected to the input winding, and a detector connected to the detection winding.

7. A transformer device comprising a transformer according to claim 3, further comprising a capacitive load circuit connected to the output winding, an AC voltage source connected to the input winding, and a detector connected to the detection winding.

8. A transformer device comprising a transformer according to claim 4, further comprising a capacitive load circuit connected to the output winding, an AC voltage source connected to the input winding, and a detector connected to the detection winding.

* * * * *